United States Patent [19]

Mičulka et al.

[11] 4,148,947

[45] Apr. 10, 1979

[54] METHOD FOR TREATING LEATHERS

[75] Inventors: Zdeněk Mičulka, Otrokovice; Vladislav Janírek, Gottwaldov, both of Czechoslovakia

[73] Assignee: Statni vyzkumny ustav kozedelny, Gottwaldov, Czechoslovakia

[21] Appl. No.: 469,425

[22] Filed: May 13, 1974

Related U.S. Application Data

[63] Continuation of Ser. No. 9,574, Feb. 9, 1970, abandoned.

[30] Foreign Application Priority Data

Feb. 10, 1969 [CS] Czechoslovakia ..... 853-69

[51] Int. Cl.[2] ..... B05D 3/12; B05D 3/02

[52] U.S. Cl. ..... 427/366; 427/336; 427/370; 427/374 B; 427/379; 427/428

[58] Field of Search ..... 117/142, 63, 65.2, 140 A, 117/155 R; 69/33; 427/366, 336, 370, 374 B, 379, 428

[56] References Cited

U.S. PATENT DOCUMENTS

| | | | |
|---|---|---|---|
| 1,370,392 | 3/1921 | Wright et al. | 69/33 UX |
| 2,304,819 | 12/1942 | Grupe | 117/63 UX |
| 2,474,884 | 7/1949 | Zihlman et al. | 69/33 X |
| 3,190,766 | 6/1965 | Yuan | 117/142 X |
| 3,201,812 | 8/1965 | Chaplin | 117/63 UX |
| 3,338,736 | 8/1967 | Hain | 117/63 X |
| 3,406,037 | 10/1968 | Pierce | 117/65.2 X |
| 3,442,685 | 5/1969 | Lohnas et al. | 117/65.2 |

*Primary Examiner*—Harry J. Gwinnell

[57] ABSTRACT

The method of treating sheet material such as leather and the like to make it supple in which the sheet material is subjected simultaneously to hot moisture and a cooling medium under pressure, alternatively from the grain side and from the flesh side in a continuous method. This is performed between two endless conveyor belts which are wetted by water, each of which is independently guided and saturated with water on the outer side and which are guided together on the inner side that is, they are guided alternatively from above and from below round a portion of the circumference of a plurality of rollers. Moistening, cooling and heating units are arranged on the outside of the rollers.

5 Claims, 1 Drawing Figure

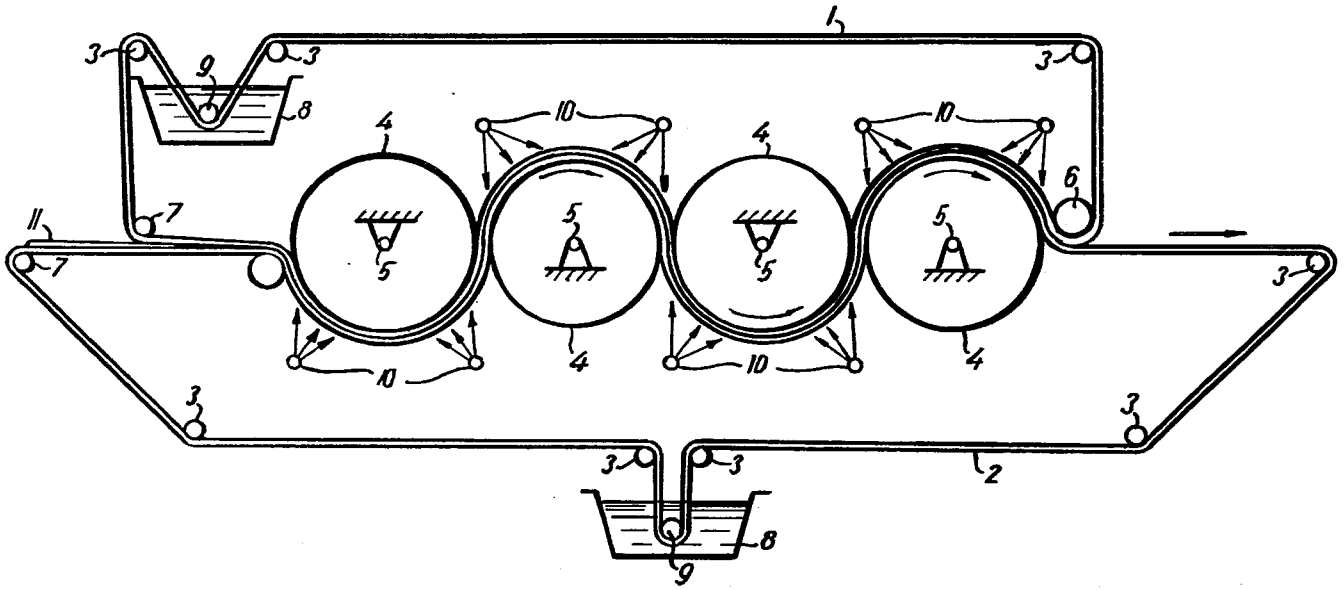
1
2
3
4
5
6
7
8
9
10
11

METHOD FOR TREATING LEATHERS

This is a continuation application of Ser. No. 9,574 filed Feb. 9, 1970, now abandoned.

The object of this invention is to provide a method of moistening sheet material such as leather, carboard, etc., in order to make it supple, as well as to provide equipment for performing the method.

For processing, many types of sheet material and particularly leather is required to be supple, and therefore, it is necessary to treat it. This is done mostly by moistening the purpose of which is to achieve a hygroscopic balance in leather. The classic method of laying the leather in wet sawdust requires difficult and legnthy handling. A more simple conditioning of leather occurs after a short immersion of the leather in water or after the leather has passed through a spraying or padding machine in which it is heated, and thus becomes well and uniformly moistened. However, all these methods require a long treatment time and none of the presently known equipment can be included in a production line.

These drawbacks are eliminated by the method of the present invention wherein sheet material such as leather and the like is subjected simultaneously to hot moisture, and a cooling medium under pressure, alternatively from the grain side and from the flesh side in a continuous method. This is performed between two endless conveyor belts which are wetted by water, each of which is independently guided and saturated with water on the outer side and which are guided together on the inner side, i.e. they are guided alternatively from above and from below round a portion of the circumference of a plurality of rollers. Moistening, cooling and heating units are arranged on the outside of the rollers.

An example of the appropriate equipment or apparatus is diagrammatically illustrated in the drawing.

Each of the two endless conveyor belts, the upper 1 and the lower one 2, is guided independently round the guiding rollers 3 on the outer portion of the runway. On the inner portion of the runway both belts 1, 2 are guided together on the portion of the circumference of active rollers 4 which are freely rotable in bearings 5. There is a greater number of active rollers 4 arranged one after the other and both conveyor belts are guided together alternatively from above and from below the rollers 4. For moving both belts 1 and 2 a common driving roller 6 cooperates with drive means from a control driving unit (not shown). Where the drive is applied directly to the active rollers, the rollers 6 acts as a guiding roller. Each of the belts 1, 2 is tightened by an independent tightening roller 7. Endless conveyor belts 1, 2 are wetted by water and for their saturation each is provided on the outer portion of the runway by the immersing through 8 provided with the roller 9. Moreover, on the outer side of the rollers 4 where the belts are guided together and opposite to the rollers 4, there are provided moistening, cooling and heating units 10. A sheet material 11, such as leather, cardboard, etc., is put between the endless conveyor belts 1, 2 which on the input portion of the rollers 4 come together in wedge-shaped method in order to facilitate the placing or insertion of sheet material. On the output portion the lower conveyor belt 2 is enlarged in order to facilitate the piece being processed to be taken off.

The technological effect of the equipment or apparatus according to the invention is distinctly evident in the case of leather which, after being stripped from plates of the paste drier, is stiff, and therefore, must be subjected to further processing to make it supple. The leather is inserted between wet endless conveyor belts 1, 2 and being clamped between them is fed to the first roller 4 which is heated to a temperature controlled within the range from 40° to 140° C. On their outer sides, the belts 1, 2 are treated with the cooling units 10. Thus, a temperature gradient developes for a quick moisture penetration into the leather in the direction of heat flow. When the conveyor belts are being transferred onto the second active roller, the outer conveyor belt contacts the heated roller, so that the heat flow is now directed from the flesh side of the leather. For the moisture to be captured in leather, two other active rollers are used which are cooled together with the units arranged on the outer side of the belts. The number of active rollers and their temperature depends on the type of the material being processed.

Equipment arranged according to the invention permits the active rollers to be heated or cooled and the respective units to serve for cooling or heating. Moreover, they can be also used for additional moistening.

The described method enables suppling sheet material in the shortest possible time in what is the necessary condition for its further processing; The equipment according to the invention is the most effective means for achieving the foregoing postulates and serves as an effective part of a continuous flow system, especially in the existing production line in tanneries prior to further processing in the through-feed staking machine.

What we claim is:

1. A method for continuously treating leather sheet material comprising the steps of supporting said sheet material between a pair of saturatable, belts, moistening said belts, conveying said belts serially through a plurality of distinct treatment stages, simultaneously in each stage applying to one belt heat and to the other belt a cooling media while subjecting said sheet material to pressure and sequentially alternating the sides on which said heat and cooling media are respectively applied in successive adjacent stages and flexing said belts during said conveying.

2. The method according to claim 1 including the steps of passing said belts over and between a plurality of cylindrical rollers, one of said belts being in contact with said rollers and the other of said belts being exposed in each stage, said cylindrical rollers comprising the source of heat and pressure for each stage and applying said cooling media on the exterior of the exposed belt in each stage.

3. The method according to claim 1 including the steps of passing said belts over and between a plurality of cylindrical rollers, one of said belts being in contact with said rollers and the other of said belts being exposed in each stage, said cylindrical rollers comprising a source of cooling media and pressure for each stage and applying said heat on the exterior of the exposed belt in each stage.

4. The method according to claim 1 wherein moisture is applied to said sheet material by passing said belts through a source of liquid.

5. The method according to claim 1 including the steps of applying moisture on said belts at each stage.

* * * * *